US010058917B2

(12) United States Patent
Harrigan, Jr. et al.

(10) Patent No.: US 10,058,917 B2
(45) Date of Patent: Aug. 28, 2018

(54) INCORPORATION OF NANO-SIZE PARTICLES INTO ALUMINUM OR OTHER LIGHT METALS BY DECORATION OF MICRON SIZE PARTICLES

(71) Applicant: Gamma Technology, LLC, Valencia, CA (US)

(72) Inventors: William C. Harrigan, Jr., Porter Ranch, CA (US); Alfred W. Sommer, Valencia, CA (US)

(73) Assignee: Gamma Technology, LLC, Valencia, CA (US)

( * ) Notice: Subject to any disclaimer, the term of this patent is extended or adjusted under 35 U.S.C. 154(b) by 467 days.

(21) Appl. No.: 14/684,037

(22) Filed: Apr. 10, 2015

(65) Prior Publication Data

US 2016/0167129 A1 Jun. 16, 2016

Related U.S. Application Data

(60) Provisional application No. 62/092,459, filed on Dec. 16, 2014.

(51) Int. Cl.
*B22F 1/00* (2006.01)
*B22F 3/105* (2006.01)
(Continued)

(52) U.S. Cl.
CPC ..... *B22F 1/0003* (2013.01); *B22F 1/0044* (2013.01); *B22F 1/02* (2013.01); *B22F 3/105* (2013.01); *B22F 3/14* (2013.01); *B22F 3/16* (2013.01); *B22F 9/04* (2013.01); *B22F 9/14* (2013.01); *C22C 21/02* (2013.01); *C22C 21/08* (2013.01); *C22C 32/0036* (2013.01); *B22F 1/025* (2013.01); *B22F 2003/1051* (2013.01); *B22F 2009/045* (2013.01); *B22F 2202/13* (2013.01); *B22F 2999/00* (2013.01)

(58) Field of Classification Search
CPC .... B22F 9/04; B22F 1/0044; B22F 2009/045; B22F 1/0003; B22F 9/14
See application file for complete search history.

(56) References Cited

U.S. PATENT DOCUMENTS 2,963,780 A 12/1960 Lyle, Jr. et al.
2,967,351 A 1/1961 Roberts et al.
(Continued)

OTHER PUBLICATIONS

Davis, J.R.. (1993). ASM Specialty Handbook—Aluminum and Aluminum Alloys—9.8.1 Powder Metallurgy. ASM International.*
(Continued)

*Primary Examiner* — Colleen P Dunn
*Assistant Examiner* — Jeremy C Jones
(74) *Attorney, Agent, or Firm* — Crowell & Moring LLP

(57) ABSTRACT

Powder metallurgy technology is used to form metallic composites with a uniform distribution of nano-meter size particles within the metallic grains. The uniform distribution of the nano-meter particles is achieved by attaching the nano-meter particles to micron sized particles with surface properties capable of attracting the smaller particles, then blending the decorated particles with micron size metal powder. The blended powder is then powder metallurgy processed into billets that are metal-worked to complete the incorporation and uniform distribution of the nano-meter particles into the metallic composite.

30 Claims, 4 Drawing Sheets

(51) Int. Cl.

| | |
|---|---|
| ***B22F 3/14*** | (2006.01) |
| ***C22C 21/02*** | (2006.01) |
| ***B22F 3/16*** | (2006.01) |
| ***C22C 21/08*** | (2006.01) |
| ***B22F 1/02*** | (2006.01) |
| ***B22F 9/04*** | (2006.01) |
| ***B22F 9/14*** | (2006.01) |
| ***C22C 32/00*** | (2006.01) |

(56) References Cited

U.S. PATENT DOCUMENTS

| | | | |
|---|---|---|---|
| 3,462,248 | A | 8/1969 | Roberts et al. |
| 3,591,362 | A | 7/1971 | Benjamin |
| 3,740,210 | A | 6/1973 | Bomford et al. |
| 3,816,080 | A | 6/1974 | Bomford et al. |
| 4,292,079 | A | 9/1981 | Pickens et al. |
| 4,297,136 | A | 10/1981 | Pickens et al. |
| 4,347,076 | A | 8/1982 | Ray et al. |
| 4,379,719 | A | 4/1983 | Hilderman et al. |
| 4,409,038 | A | 10/1983 | Weber |
| 4,647,321 | A | 3/1987 | Adam |
| 4,828,632 | A | 5/1989 | Adam et al. |
| 4,878,967 | A | 11/1989 | Adam et al. |
| 4,879,095 | A | 11/1989 | Adam et al. |
| 7,288,133 | B1 | 10/2007 | Peng et al. |
| 7,297,310 | B1 | 11/2007 | Peng et al. |
| 8,057,203 | B2 | 11/2011 | Parker et al. |
| 8,323,373 | B2 | 12/2012 | Haynes, III et al. |
| 8,343,394 | B2 | 1/2013 | Parker et al. |
| 2004/0137218 | A1* | 7/2004 | Liu ..... B22D 17/007 428/328 |
| 2005/0106056 | A1* | 5/2005 | Peng ..... C22C 1/05 419/8 |
| 2006/0153728 | A1* | 7/2006 | Schoenung ..... B22F 9/04 419/32 |
| 2008/0069716 | A1 | 3/2008 | Chelluri et al. |
| 2009/0208362 | A1* | 8/2009 | Harrigan, Jr. ..... C22C 21/14 420/534 |
| 2010/0124514 | A1 | 5/2010 | Chelluri et al. |

OTHER PUBLICATIONS

PCT International Search Report and Written Opinion dated Apr. 1, 2016, PCT Appln. No. PCT/US2015/065601, 10 pages.

Gamma Technology, LLC, "International Preliminary Report on Patentability", PCT Application No. PCT/US2015/065601, (dated Jun. 29, 2017).

* cited by examiner

Aluminum Particle

Decorate with Nano Particles

Consolidate to Solid

Shear to Homogenize Particles

Baseline 6063 Aluminum

6063 Aluminum Composite
with 5% nano-meter size particles

INCORPORATION OF NANO-SIZE PARTICLES INTO ALUMINUM OR OTHER LIGHT METALS BY DECORATION OF MICRON SIZE PARTICLES

CROSS-REFERENCE TO RELATED APPLICATION

This application claims the benefit of U.S. provisional application Ser. No. 62/092,459, filed Dec. 16, 2014.

FIELD OF THE INVENTION

The present invention relates generally to the field of aluminum and other metal alloys and, more particularly, to processes for distributing nano-meter size particulates within the metallic grains of an alloy.

BACKGROUND OF THE INVENTION

Aluminum and aluminum alloys have been strengthened by several techniques. One method involves the addition of soluble elements such as magnesium, copper, silicon or zinc that strengthen the crystal structure of the alloy by replacing an aluminum atom in the lattice randomly with an atom of a different element. This is known as solid solution strengthening and leads to modest strength improvements. A second strengthening method is alloying the aluminum metal with elements such as copper, magnesium, silicon or zinc that have solubility in the aluminum crystal structure at elevated temperature. These elements have reduced solubility as the temperature is reduced to room temperature, resulting in precipitation of a second phase containing the added element. By controlling the cooling rate from an elevated temperature, a supersaturated solid solution can be obtained. This supersaturated solution can be manipulated by a combination of temperature and time to allow controlled precipitation in the aluminum crystal structure. This is the most common technique for strengthening aluminum alloys. Alloys such as 2024 aluminum contain copper and magnesium to generate precipitation, 6061 aluminum contain magnesium and silicon that generate precipitation and 7075 aluminum contains zinc, copper and magnesium that generate precipitates. As the use temperature of the alloy increases, the precipitates tend to agglomerate and loose their ability to impede dislocation motion and to impart strength.

Methods of obtaining improved tensile strength in aluminum based alloys have been described in U.S. Pat. No. 2,963,780 to Lyle et al.; U.S. Pat. No. 2,967,351 to Roberts, et al.; and U.S. Pat. No. 3,462,248 to Roberts, et al. The alloys taught by Lyle, et al. and by Roberts, et al. were produced by atomizing liquid metals into finely divided droplets by high velocity gas streams. The droplets were cooled by convective cooling at a rate of approximately $10^{4}$° C. per second. As a result of this rapid cooling, Lyle, et al. and Roberts, et al. were able to produce alloys containing substantially higher quantities of transition elements than has hither to been possible.

Higher cooling rates using conductive cooling, such as splat quenching and melt spinning, have been employed to produce cooling rates of about $10^{5}$ to $10^{6}$° C. per second. Such cooling rates minimize the formation of large intermetallic precipitates, with acicular or blocky morphology, during the solidification of the molten aluminum alloy. Such intermetallic precipitates are responsible for premature tensile instability.

U.S. Pat. No. 4,379,719 to Hilderman, et al. discusses rapidly quenched aluminum alloy powder containing 4 to 12 wt % iron and 1 to 7 wt % cerium or other rare earth metals from the lanthanum series. U.S. Pat. No. 4,647,321 to Adam discusses rapidly quenched aluminum alloy powder containing 5 to 15 wt % iron and 1 to 5 wt % of other transition elements. U.S. Pat. No. 4,347,076 to Ray, et al. discusses high strength aluminum alloys for use at temperatures of about 350° C. that have been produced by rapid solidification techniques. These alloys, however, have low engineering ductility and fracture toughness at room temperature, which precludes their employment in structural applications where a minimum tensile elongation of about 3% is required. U.S. Pat. Nos. 4,828,632; 4,878,967 and 4,879,095 to Adam et al. discuss rapidly solidified aluminum base alloy powder products of Al—Fe—Si—X where X is specifically vanadium or at least one element from the group V, Mn, Cr, Mo, W, Ta or Nb. These techniques have resulted in high strength alloys that generally suffer from low tensile ductility at room temperature. The alloys have very high strength at elevated temperatures and therefore suffer from the lack of workability. The alloys tend to be unstable at higher temperatures and catastrophic precipitate growth occurs rendering the alloys unusable due to reduced strength and induced brittleness.

The use of powder metallurgy routes to produce high strength aluminum has been proposed and has been the subject of considerable research. Powder metallurgy techniques generally offer a way to produce homogenous materials, to control chemical composition and to incorporate dispersion strengthening particles into the alloy. Also, difficult-to-handle alloying elements can at times be more easily introduced by powder metallurgy than ingot melt techniques. The preparation of dispersion strengthened powders having improved properties by a powder metallurgical technique known as mechanical alloying has been disclosed, e.g., in U.S. Pat. No. 3,591,362. Mechanically alloyed materials are characterized by fine grain structure, which is stabilized by uniformly distributed micron sized particles such as oxides and/or carbides. U.S. Pat. Nos. 3,740,210 and 3,816,080 pertain particularly to the preparation of mechanically alloyed dispersion strengthened aluminum. Other aspects of mechanically alloyed aluminum-base alloys have been disclosed in U.S. Pat. Nos. 4,292,079; 4,297,136 and 4,409,038; such as, the requirement to off-gas the blended powder due to hydrogen absorption during the ball-milling operation. In addition to the need for off-gassing, the powder must be handled in a controlled atmosphere because the fresh surface created by the ball milling renders the powder pyrophoric. The rapid oxidation of the fine powder can result in a fire or an explosion. These difficulties make these processes difficult to scale-up and the materials have not been widely used.

In precipitation strengthened aluminum alloys, the precipitates which elevate the strength of such alloys will grow in size, agglomerate and eventually dissolve into the matrix as the temperature is raised, severely degrading the strength of the alloy. The introduction of strong inert nano-meter ($10^{-9}$ m) sized particles into aluminum is desirable because these particles have similar size as precipitate particles are initially and will inhibit dislocation motion in the aluminum grains. This will result in high strength aluminum. Being inert, the nano-meter sized particles will not react with the aluminum matrix, the strength of the alloy will be relatively unchanged at all temperatures up to the melting temperature. Several techniques have been employed to introduce nano-meter sized particles into aluminum. The high-energy ball mill process described earlier has been used to break-up larger particles of aluminum to generate nano-sized aluminum particles whose strength declines as the temperature rises. This process results in the generation of wide range of particle sizes and has problems with scale-up. U.S. Pat. Nos. 7,297,310 and 7,288,133 and U.S. Pat. No. 8,323,373B2 disclose using the oxide layer that is present on all aluminum powder as the source for nano-sized aluminum oxide particles. These processes require the use of fine aluminum powders in order to have sufficient aluminum oxide present to create a usable composite. As the powder size is reduced to a size where sufficient oxide is present for composite production, the price of the powder becomes too high for commercial processes and is extremely dangerous to handle because of its pyrophoric property. For example, U.S. Pat. No. 8,323,373B2 teaches that the oxide thickness on the aluminum particles is approximately 5 nm regardless of the atomization process. By geometry, one is able to calculate that particles with 30 micron diameter will have an oxide content of 0.1 volume percent with the 5 nm thick oxide layer. The oxide content will increase to 0.15 volume percent for 20 micron particles, to 0.3 volume percent for 10 micron particles and to 0.6 volume percent for 5 micron particles. The aluminum particle size must be reduced to 1 micron in order for the alumina content to become 3 volume percent.

Other techniques that have been evaluated for incorporation of nano-sized ceramic particles into aluminum or other light metals are pressure infiltration and direct mixing of aluminum powder with nano-meter sized particles. The pressure infiltration process involves the production of a reinforcement mat or block. The reinforcement block is placed into a mold and the mold cavity is sealed. Molten aluminum is poured on to the block and a gas pressure is applied to the top surface of the molten aluminum. The pressure forces the molten aluminum between the particles. As the particle size is decreased to the nano-meter size, the pressure needed to cause infiltration becomes too high for normal commercial equipment. The nano-meter particles of aluminum oxide are not naturally wet by molten aluminum so infiltration is only achieved by the use of extremely high pressures.

Fine aluminum oxide powder is a nonconductor of heat or electricity. Static electricity generated by particle movement causes the powder to agglomerate. Because of the static charge, the agglomerates are difficult to break apart. As the particle size is reduced from a micron size to a nano size ($10^{-6}$ m to $10^{-9}$ m) the tendency to tightly agglomerate increases. Several investigators have attempted to blend the nano-meter size particles into commercial aluminum powders using high shear techniques and high-energy ball mill techniques. These attempts resulted in materials with agglomerates at grain boundaries and at prior aluminum particle boundaries. The majority of the nano-meter size particles were contained in the agglomerates and poor mechanical properties were observed.

The Swiss Federal Laboratories for Material Science and Technology (EMPA) in Thun, Switzerland has shown that it is possible to produce spherical nano sized alumina ($Al_2O_3$) particles by use of plasma flame equipment. Metal matrix composite (MMC) material developed at EMPA with nano-size reinforcement particles in an aluminum alloy matrix has been shown to be considerably harder than one reinforced with micron sized particles. However, implanting nano-sized alumina particles into aluminum alloy matrices is rather difficult today simply because the alumina particles are so small that transporting them from the plasma reactor where they are made to the interior of the matrix alloy requires very expensive processing. Additionally, the nano alumina particles tend to agglomerate during transport. The segregation of the nanoparticles results in less than anticipated properties in the ultimate metal matrix composite. We must therefore use innovative techniques to introduce nanoparticles into our composites.

Some work at EMPA has reported that it is possible to coat the surface of micron size alumina with nano-sized particles of the same ceramic composition. In the invention described below, a process of coating nano-size particles on micron size spheres of alumina is utilized as a practical means of introducing significant volume fractions of nano-spheres into MMC materials in a cost effective manner, without the special processing noted above. After powder ingot manufacturing and metal working, this is found to result in dispersion of the nano-size particles with the uniformity that is achievable today with micron size particles.

Some work has been done as well at Gamma Technology that has shown that nano-sized alumina particles can be directly coated onto simple micron sized particles of metallic aluminum at room temperature. This vastly simplifies the manufacture the resulting composite by avoiding the need to coat the nano alumina particles on to micron sized alumina particles on the fly in a plasma flame.

While the handling and transport of micron size ceramic particles in industry today can be done economically, handling large volumes of nano-size powders has been very expensive until now. Using micron size particles of either alumina or aluminum as a carrier in order to incorporate the smaller particles into an MMC will drastically lower the price for the composite. This technique will also allow us to uniformly distribute the nanoparticles during subsequent metal working of the composite. This recipe will produce materials with an increase in properties above that of MMC material to which nano alumina particles have not been deliberately added.

SUMMARY OF THE INVENTION

The present invention is directed to the use of powder metallurgy technology to form aluminum composites with superior strength at room temperature, elevated temperatures and at cryogenic temperatures. The invention accomplishes this through the use of nanotechnology applied to particulate materials incorporated within the aluminum alloy. The alloy's mechanical properties are achieved by a uniform distribution of nano-meter size particles within the aluminum grains. The uniform distribution of the nano-meter particles in the MMC is achieved by first attaching the nano-meter alumina particles to micron sized particles of either alumina or aluminum. The decorated micron size particles are blended with additional aluminum powders. The blended powders are processed into compacted billets that are metal-worked to complete the incorporation and uniform distribution of the nano-meter particles into the aluminum metal.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
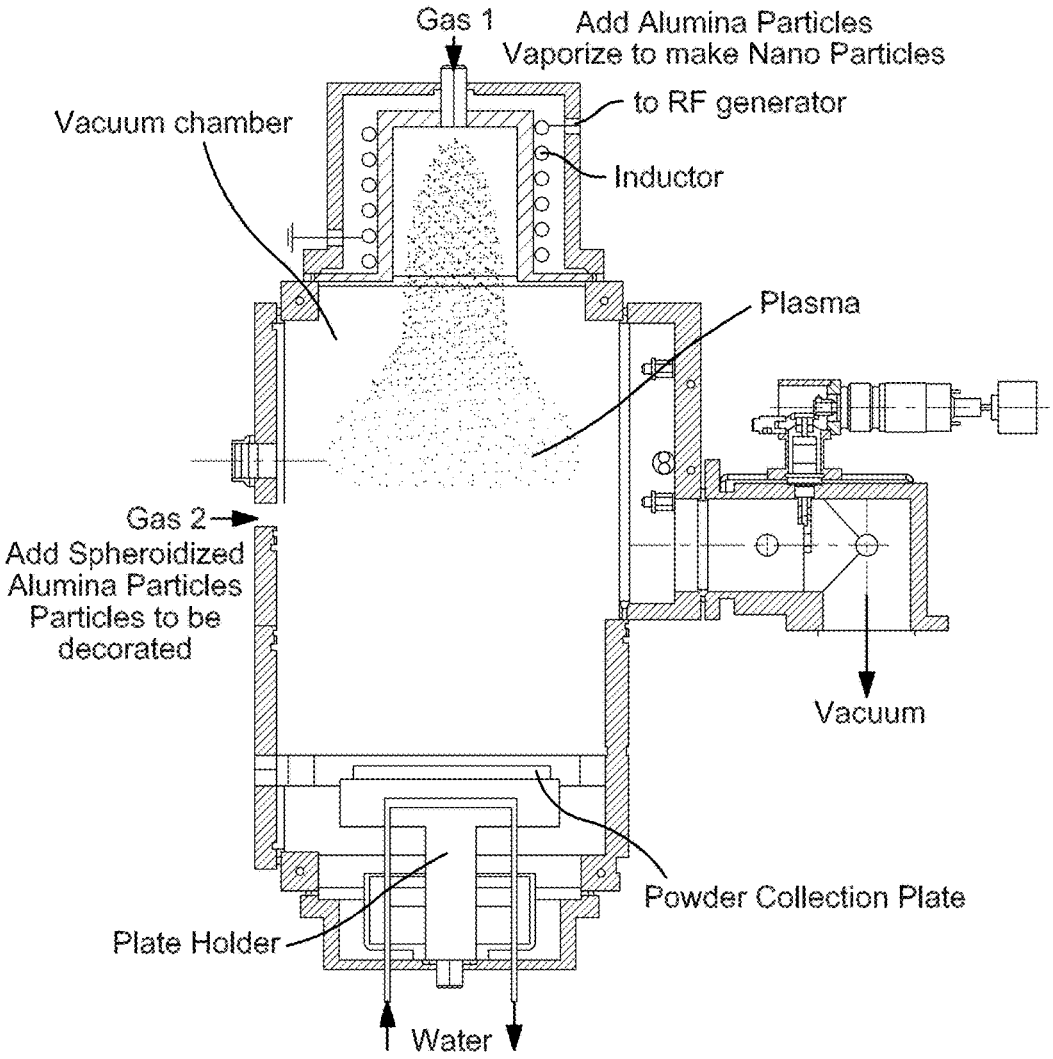
FIG. 1 is a schematic diagram of a plasma chamber in which nano-meter size particles are formed and attached to micron size particles.

One technique for making nano-meter size particles of alumina is to pass micron size particles of alumina through a plasma, vaporize the alumina while the particles are in the plasma hot zone and condense the nano-micron size particles when the vaporized alumina emerges from the hot zone. A representation of this process is shown in FIG. 1, where the particles to be vaporized are introduced into the chamber at the top with Gas 1. The nano-meter sized particles of alumina emerge from the bottom of the plasma and are collected on a lower plate. Proceeding in this way involves using some very costly processes for handling a large population of nano-meter sized particles directly as one attempts to incorporate the nano-meter size alumina particles into an aluminum alloy matrix to generate the composite.

The present invention may use spherical alumina produced in accordance with U.S. Pat. Nos. 8,057,203 and 8,343,394, the disclosures of which are incorporated herein by reference, as a carrier to introduce the nano-meter size alumina particles into an aluminum alloy or other light metal alloy. The nano-meter particles are attached to micron size alumina particles directly after the manufacture of the nano-meter alumina particles. Once the nano-meter alumina particles are attached to micron size alumina or aluminum metal particles, one can use conventional powder metallurgy techniques to introduce the micron size particles, with attached nano-meter alumina particles into an aluminum metal matrix to create the required composite Another process within the scope of this invention involves adding a secondary process to the plasma generation of nano-meter sized particles. Referring again to FIG. 1, spherical micron sized alumina particles are introduced into the chamber with Gas 2 below the plasma. This is a cooler zone where the nano-meter sized particles are being formed by condensation of the vaporized alumina. The nano-meter sized particles form and are electrostatically attached to the micron size spherical particles, resulting in layers of small particles being attached to the larger particles. The decorated spherical particles then fall to the collection plate and are removed from the chamber at the end of the run.

Other techniques that allow nano-meter size particles to be attached or attracted to micron size particles are also within the scope of this invention. The micron size particles can be irregular alumina particles or aluminum particles that have an alumina shell. It is known that oxides exist on atomized aluminum powder regardless of the type of atomization gas used to manufacture. See, "Metals Handbook Ninth Edition Volume 7—Powder Metallurgy" by Alcoa Labs. The naturally occurring aluminum oxide assists in allowing the additional deliberately added nano-size alumina particles to attach to the aluminum particles. One must also provide an environment where the added nano alumina particles are in a lower energy state when they adhere to the aluminum micron size particles than when they agglomerate together electrostatically.

Among the other techniques for decorating micron size particles with nano-meter size particles is the high shear blending of nano-meter-size particles with micron size particles. The shear action of the blender breaks up agglomerates of the nano-meter size particles and allows individual particles to interact and attach to micron size particles. The static electricity generated by the shear motion of the particles keeps the nano-size particles attached to the micron size particles.

Once the nano-meter size particles are attached to the micron size particles, a composite is made by blending the decorated micron size particles with additional aluminum powders and processing the blended powders into a billet using a standard powder metallurgy process. At the billet stage, the nano-meter size particles are still associated with the micron size particles. The billet must be metal worked to allow shear deformation to redistribute the nano-meter size particles throughout the matrix. An extrusion process is a common metal working operations used for this purpose.

Nano alumina particles produced by either condensation of particles from a plasma or produced by thermal decomposition of organo-metallic compounds can be deagglomerated or separated by being placed in a polar fluid at room temperature and exposed to high shear mixing such as produced by Ross Series 700 Ultra-High Shear Mixers. One such polar fluid is isopropyl alcohol that is compatible with both the nano alumina and the aluminum powder. The free nano alumina particles are then attached to aluminum alloy micron sized powders by combining the two types of powder in at room temperature in a vessel filled with a polar fluid such as isopropyl alcohol. The combined mixture is blended with a "V" blender using an intensifier bar for 20 minutes. The polar fluid is evaporated from the final blend and the nano alumina particles are found to be attached to the aluminum powder by static electricity. The powder is then processed into billets. The billets are then metal worked to incorporate and scatter the nano alumina particles within the matrix alloy.

In a first example, the process described herein was used to make a composite with GA-2 matrix alloy with 10 volume percent of the decorated micron size spherical alumina particles, GA-2-10D. The nano-meter size particles made up an estimated 3 to 5percent of the total alumina added. Therefore, the composite that was made contained between 0.3 and 0.5 percent by volume of the nm-size particles. The billet size was 25 mm diameter by 13 mm long. The billet was made by heating the powder with the passage of electric current through the powder and applying a pressure of approximately 9 bars once the powder reached the desired temperature, 480° C. to 510° C. The process was done in a vacuum. The process is referred to as spark plasma sintering (SPS). The billet then had a 12.5 mm diameter extrusion plug machined from the center. This plug was warm extruded into a 5.6 mm diameter rod. This is an extrusion area ratio of 5.16:1. This is a low extrusion ratio but will convert the powder metallurgy billet into a wrought rod, and incorporate the nano-meter size particles into the matrix grains.

Figure 2:
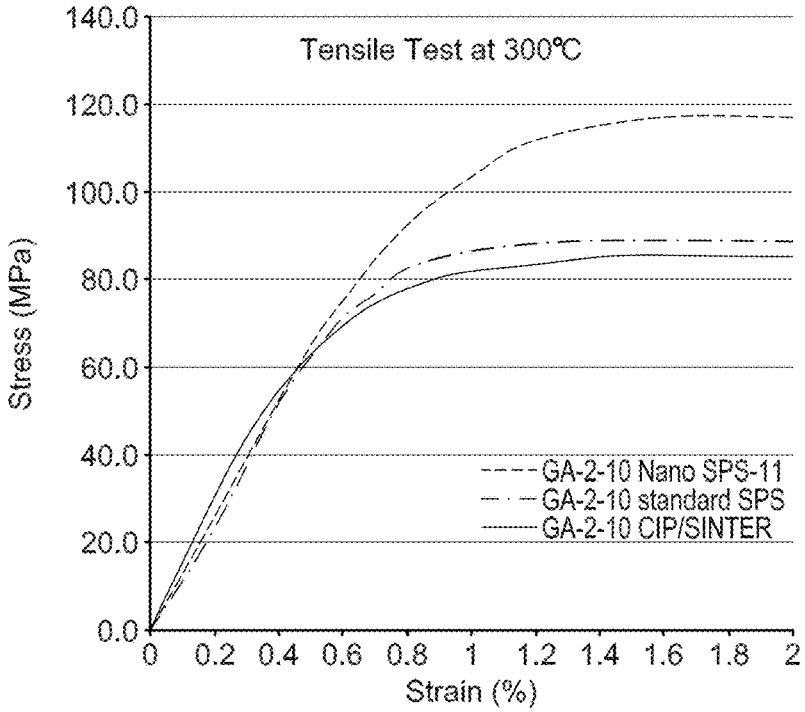
FIG. 2 is a plot of the low strain region of stress-strain curves for standard GA-2-10 composite and of a GA-2-10 composite containing nano-meter size particles formed in accordance with the present invention.
Figure 3:
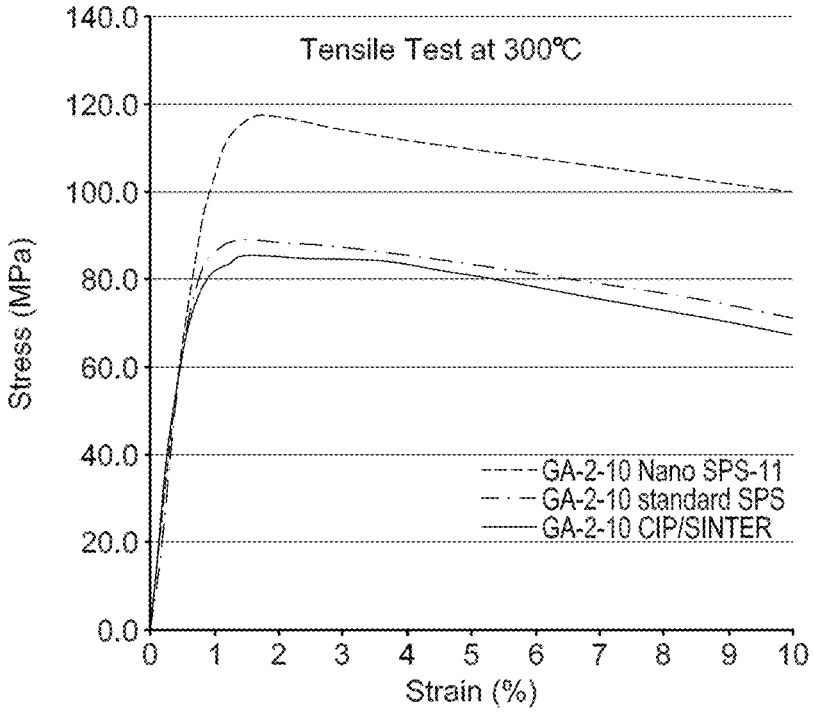
FIG. 3 is a plot of stress-strain curves for standard GA-2-10 composite and of a GA-2-10 composite containing nano-meter size particles formed in accordance with the present invention.

In order to assess the success of incorporating the nano meter oxide particles into the aluminum, we ran tensile tests at 300 degree C. on nano-meter particle containing composite and standard GA-2-10 composites made by the SPS process. At this temperature all the strengthening due to heat treatment induced precipitates in the GA-2 alloy will be eliminated due to over-aging of the precipitates. The strengthening brought about by the nano-meter size particles will remain. Identical tests were also conducted on standard GA-2-10 composite samples that were powder metallurgy processed by cold isostatic pressing (CIP) followed by sintering and then extruded from a 89 mm billet to a 15.9 mm rod, an extrusion area ratio of 36:1. Stress-strain curves generated by each of the three types of metals are shown in FIGS. 2 and 3. FIG. 2 is the stress strain behavior of the materials at low strain, up to 2 percent. FIG. 3 is the stress strain behavior of the materials up to ten percent strain. Both of these figures show that the standard SPS material and the CIP/Sinter materials behave in a similar manner. These materials have a proportional limit at about 60 MPa. Above this stress the standard materials yield and the stress increases by work hardening to a yield stress of around 80 MPa. The material that contains nano-meter particles has a stress-strain curve that is similar to the other materials up to the 60 MPa proportional limit. Above 60 MPa, the nano-meter containing material work hardens at a higher rate to a yield stress of about 120 MPa. At 80 MPa for the standard composite and 120 MPa for the nano-meter containing material the samples undergo creep deformation until failure occurs at about 10 percent elongation as shown in FIG. 3.

Figure 4A:
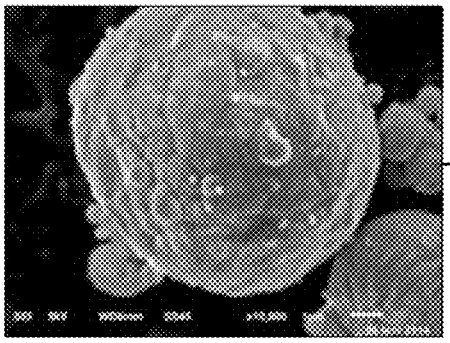
FIGS. 4A-4D are Scanning Electron Microscope (SEM) micrographs of material at different stages of manufacturing of nano-meter size alumina reinforced aluminum composites: aluminum particle (FIG. 4A), aluminum particle decorated with nano-meter size alumina particles (FIG. 4B), decorated particles consolidated into a solid (FIG. 4C) and consolidated solid extruded into rod with alumina particles uniformly distributed (FIG. 4D).
Figure 4B:
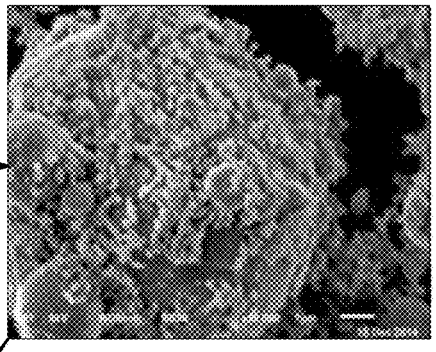
Figure 4C:
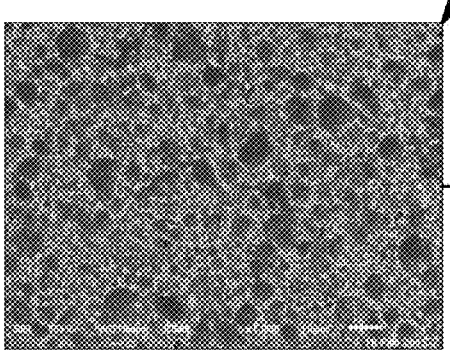
Figure 4D:
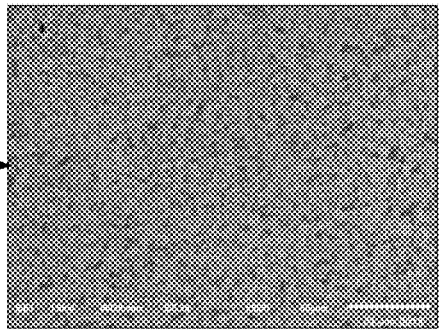

In a second example, the process described herein was used to make a composite with a 6063 Aluminum matrix, 0.7 Mg, 0.4 Si. This matrix alloy was mixed with isopropyl alcohol, then sufficient nano alumina particles that have been commercially processed into a colloidal suspension are added to the aluminum-alcohol blend. The combined blends are processed in a blender at high speed for 3 minutes and the blend is dried. The composites were made containing 1.5%, 5% and 10% nano meter size particles respectively. These composites were processed by the SPS technique described earlier. The billet 25 mm diameter by 13 mm thick then had a 12.5 mm diameter extrusion plug machined from the center. This plug was warm extruded into a 5.6 mm diameter rod. This is an extrusion area ratio of 5.16:1. This is a low extrusion ratio but will convert the powder metallurgy billet into a wrought rod, and incorporate the nano-meter size particles into the matrix grains as we have shown earlier in the GA2-20 metal tested at 300° C. The microstructure of the aluminum composite at different stages of the processing is contained in FIG. 4. FIG. 4 is a series of Scanning Electron Microscope, SEM, micrographs of material at different stages of manufacturing of nano-meter size alumina reinforced aluminum composites. FIG. 4A is an aluminum particle. FIG. 4B is an aluminum particle decorated with nano-meter size alumina particles. FIG. 4C is a consolidated solid with decorated particles forming rings around prior particle boundaries. FIG. 4D is the consolidated solid extruded into rod with alumina particles uniformly distributed.

Tensile samples were machined from the extruded rods and the machined tensile samples were annealed at 480° C. for 2 hours followed by furnace cooling to 120° C in order to remove any residual work hardening and hardening precipitates from the warm extrusion. Room temperature tensile tests were conducted in these composites. Room temperature elastic moduli were measured by ultrasonic velocity measurements. The test data is contained in Table 1. These data demonstrate the increase in elastic modulus and strength brought about by the addition of the nano particles. The strength increase is more significant than the modulus, as expected for the small amount of reinforcement addition.

| Material Description | Elastic Modulus (GPa) | Yield Strength (MPa) | Ultimate Strength (MPa) | Elongation (%) |
|---|---|---|---|---|
| 6063 Aluminum-Metals Handbook | 69.0 | 89.6 | 152 | 33.0 |
| 6063/1.5% nano | 70.7 | 188.2 | 218 | 24.0 |
| 6063/5% nano | 77.2 | 221 | 269 | 26.0 |
| 6063/10% nano | 81.4 | 245 | 303 | 18.3 |

Figure 5A:
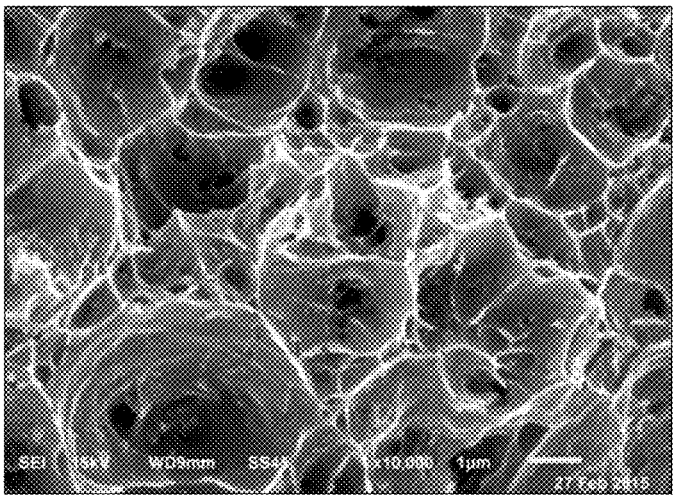
FIG. 5A is a SEM micrograph of the tensile fracture surface of 6063 aluminum.
Figure 5B:
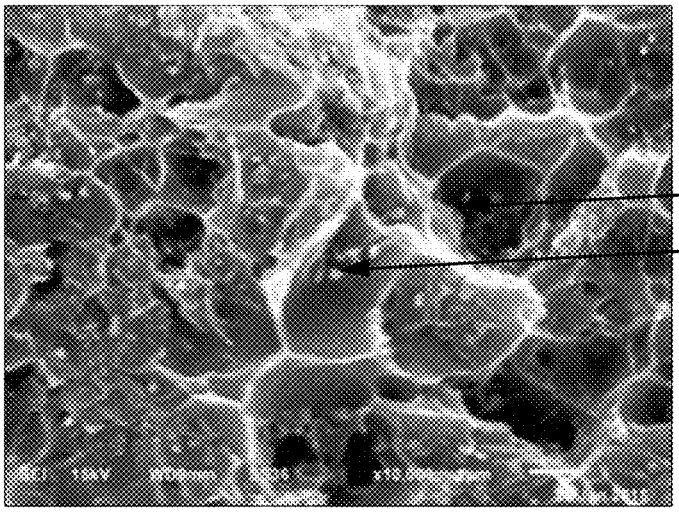
FIG. 5B is a SEM micrograph of the tensile fracture of a 6063 matrix composite containing 5% nano-meter size alumina particles.

Scanning electron microscopy was carried out on the fracture surfaces of the tensile samples. As seen in FIG. 5A, the fracture surface of the baseline 6063 contains highly deformed ligaments of aluminum. FIG. 5B shows that the fracture surface of the nano-meter particle-containing composite also contains highly deformed ligaments. These ligaments were more segmented and contained many particles less than 100 nano-meter in diameter. These particles are the nano-size particles added during the processing according to this patent.

In a third example, the process described herein may be used to make a composite by using the CIP/Sinter process. Nano-meter decorated micron size particles are blended with an aluminum alloy powder with a total alumina content of 20 volume percent, aluminum alloy content of 80 volume percent. The blended powder is placed in a rubber mold and the powder is compacted to approximately 50 percent theoretical density. The rubber mold is sealed and evacuated by a vacuum pump to approximately 1 Torr. The sealed and evacuated rubber mold is placed in a cold isostatic chamber, a large pressure vessel, and a pressure of approximately 50,000 to 80,000 psi is applied within the pressure vessel. The pressure is applied for several minutes and then removed. This process produces a powder compact that is between 85 and 95 percent of theoretical density. This is necessary so the compacted powder can be outgassed during the sinter operation.

The compacted mixture is then sintered in vacuum, or inert-gas atmosphere. The compacted powder is heated to a sintering temperature that is the highest eutectic melt temperature of the compacted mixture so that sintering of the matrix takes place to form the composite billet. This sintered composite billet has a density that is still approximately that of the starting compacted mixture, between 85% and 95% of the theoretical density, but is sealed by the transient eutectics that are present during the sintering process.

The billet is then heated to approximately 425° C. and then extruded. The extrusion may be a rod or other shape with a ratio of area of the billet divided by the area of the shape of greater than 10 to 1, preferably greater than 20 to 1. After the extrusion process the nm size particles are contained within the aluminum matrix grains.

A fourth method for producing composites is by vacuum hot pressing. Blended powder is placed in a steel die. The steel die can be any desired size and can contain several kilograms of the blended powder. The powder is typically compacted at room temperature to a theoretical density of between 60 and 80 percent of theoretical. The die, powder and punch assembly are placed in a vacuum container and a vacuum of approximately 1 Torr is established. The vacuum container and die assembly are heated to a consolidation temperature, typically between 450° C. and 565° C. Once the temperature of the blended powder is uniform, a pressure is applied to the punch assembly and the composite is consolidated to a density of greater than 95 percent theoretical. The billet is then metal worked to liberate the nm size particles from the surface of the micron size particles and the nm particles are incorporated into the matrix alloy grains.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims. In particular, but without limitation, particular embodiments of the invention have been described in the context of aluminum and aluminum alloys. It is to be understood that the invention may also be applied to other metals and alloys.

What is claimed is:

1. A process for manufacturing a metal matrix composite consisting of:

placing nano-meter size particles in a polar fluid;

deagglomerating the nano-meter size particles in the polar fluid;

combining the deagglomerated nano-meter size particles with micron size particles in the polar fluid;

high-shear blending the combined nano-meter and micro size particles;

evaporating the polar fluid allowing the nano-meter size particles to electrostatically attach to the micron size particles forming a powder of the micron size particles with the nano-meter size particles attached thereto.

2. The process of claim 1 wherein the metal matrix is aluminum.

3. The process of claim 2 wherein the nano-meter size particles are alumina.

4. The process of claim 3 wherein the micron size particles are alumina.

5. The process of claim 3 wherein the micron size particles are aluminum.

6. The process of claim 3 wherein the micron size particles are an aluminum alloy.

7. The process of claim 1 wherein the metal matrix is an aluminum alloy.

8. The process of claim 7 wherein the nano-meter size particles are alumina.

9. The process of claim 8 wherein the micron size particles are alumina.

10. The process of claim 8 wherein the micron size particles are aluminum.

11. The process of claim 8 wherein the micron size particles are an aluminum alloy.

12. The process of claim 1 further comprising processing the powder of micron size particles with nano-meter size particles attached thereto into a billet and then metal working the billet to redistribute the nano-meter size particles within the metal matrix.

13. The process of claim 12 wherein the powder of micron size particles with nano-meter size particles attached thereto is processed into a billet by spark plasma sintering.

14. The process of claim 12 wherein the powder of micron size particles with nano-meter size particles attached thereto is processed into a billet by cold isostatic pressing followed by sintering.

15. The process of claim 12 wherein the powder of micron size particles with nano-meter size particles attached thereto is processed into a billet by vacuum hot pressing.

16. A process for manufacturing a metal matrix composite comprising:

providing nano-meter size particles;

attaching the nano-meter size particles to micron size particles;

combining the micron size particles with nano-meter size particles attached thereto into a metal matrix;

wherein the nano-meter size particles are produced in a plasma jet and wherein the micron size particles are introduced into the plasma stream such that the nano-meter size particles electrostatically attach to the micron size particles.

17. The process of claim 16 wherein the metal matrix is aluminum.

18. The process of claim 17 wherein the nano-meter size particles are alumina.

19. The process of claim 18 wherein the micron size particles are alumina.

20. The process of claim 18 wherein the micron size particles are aluminum.

21. The process of claim 18 wherein the micron size particles are an aluminum alloy.

22. The process of claim 16 wherein the metal matrix is an aluminum alloy.

23. The process of claim 22 wherein the nano-meter size particles are alumina.

24. The process of claim 23 wherein the micron size particles are alumina.

25. The process of claim 23 wherein the micron size particles are aluminum.

26. The process of claim 23 wherein the micron size particles are an aluminum alloy.

27. The process of claim 16 further comprising processing the powder of micron size particles with nano-meter size particles attached thereto into a billet and then metal working the billet to redistribute the nano-meter size particles within the metal matrix.

28. The process of claim 27 wherein the powder of micron size particles with nano-meter size particles attached thereto is processed into a billet by spark plasma sintering.

29. The process of claim 27 wherein the powder of micron size particles with nano-meter size particles attached thereto is processed into a billet by cold isostatic pressing followed by sintering.

30. The process of claim 27 wherein the powder of micron size particles with nano-meter size particles attached thereto is processed into a billet by vacuum hot pressing.

* * * * *